US010584846B2

(12) United States Patent
Joerg et al.

(10) Patent No.: US 10,584,846 B2
(45) Date of Patent: Mar. 10, 2020

(54) LIGHTING DEVICE WITH LENS AND METHOD FOR PRODUCTION THEREOF

(71) Applicant: LEDVANCE GmbH, Garching bei München (DE)

(72) Inventors: Anton Joerg, Eitensheim (DE); Thomas Klafta, Maxhüte-Haidhof (DE); Wolfgang Seitz, Eichstät (DE); Christoph Steidl, Eichstät (DE); Marcel Vuc, Ingolstadt (DE)

(73) Assignee: LEDVANCE GMBH, Garching bei Munchen (DE)

( * ) Notice: Subject to any disclaimer, the term of this patent is extended or adjusted under 35 U.S.C. 154(b) by 0 days.

(21) Appl. No.: 16/037,347

(22) Filed: Jul. 17, 2018

(65) Prior Publication Data

US 2019/0032887 A1 Jan. 31, 2019

(30) Foreign Application Priority Data

Jul. 26, 2017 (DE) ..... 10 2017 116 932

(51) Int. Cl.

| | |
|---|---|
| ***F21V 5/04*** | (2006.01) |
| ***F21V 23/00*** | (2015.01) |
| ***F21V 29/70*** | (2015.01) |
| ***F21K 9/233*** | (2016.01) |
| ***F21V 23/06*** | (2006.01) |
| *F21K 9/238* | (2016.01) |
| *F21K 9/235* | (2016.01) |
| *F21K 9/237* | (2016.01) |

(52) U.S. Cl.

CPC ..... *F21V 5/04* (2013.01); *F21K 9/233* (2016.08); *F21V 23/003* (2013.01); *F21V 23/005* (2013.01); *F21V 23/06* (2013.01); *F21V 29/70* (2015.01); *F21K 9/235* (2016.08); *F21K 9/237* (2016.08); *F21K 9/238* (2016.08)

(58) Field of Classification Search

CPC ..... F21V 5/04; F21V 23/06; F21V 23/003; F21K 9/238; F21K 9/237; F21K 9/235

See application file for complete search history.

(56) References Cited

U.S. PATENT DOCUMENTS

| | | | | |
|---|---|---|---|---|
| 2008/0130137 | A1 | 6/2008 | Angelini et al. | |
| 2009/0268470 | A1 | 10/2009 | Okimura et al. | |
| 2011/0180819 | A1 | 7/2011 | Van Elmpt et al. | |
| 2017/0146199 | A1* | 5/2017 | Weng | F21K 9/233 |

FOREIGN PATENT DOCUMENTS

| | | | |
|---|---|---|---|
| DE | 102007034123 | A1 | 1/2009 |
| DE | 102014213388 | A1 | 1/2016 |

* cited by examiner

*Primary Examiner* — David V Bruce
(74) *Attorney, Agent, or Firm* — Hayes Soloway PC

(57) ABSTRACT

A lighting device and the method of creating the lighting device having a lighting module and a lens mechanically connected to that lighting module. The lens has one or more connecting pins. The light module has one or more receiving openings for receiving the connecting pins. The free ends of the connecting pins are deformed by thermal deformation so that the light module is held on the lens.

20 Claims, 2 Drawing Sheets

LIGHTING DEVICE WITH LENS AND METHOD FOR PRODUCTION THEREOF

CROSS-REFERENCE TO RELATED APPLICATIONS AND PRIORITY

This patent application claims priority from German Patent Application No. 102017116932.6 filed Jul. 26, 2017, which is herein incorporated by reference in its entirety.

TECHNICAL FIELD

The present invention relates to a lighting device, in particular a retrofit lighting device with a housing and a lens, through which the light generated by a light module in the interior of the housing can exit from the lighting device. The invention relates in particular to the mechanical connection between the light module and the lens. The invention is in particular applicable to LED retrofit lamps for replacing halogen reflector lamps, in particular MR16 and PAR16 lamps.

PRIOR ART

In LED lamps with a lens (for example reflector lamps), the lens is usually mounted on the housing by a snap connection, by gluing or by means of a screw connection.

A light fixture and a method are known from German Patent Application DE 10 2016 114 643, in which the lens is connected to a light module. The light module and the lens are then jointly inserted into a housing and connected thereto. The above-mentioned methods can likewise be used for fastening of the lens on the light module.

In the case of a snap connection (also referred as a latching connection), there is the risk that the connection dissolves again later, for example because of external mechanical influences or due to thermally induced expansion, and the light fixture falls apart.

An adhesive connection can lead to unwanted gas emissions or to optical faults. Moreover, during adhesion, a corresponding waiting time must be provided for the curing of the adhesive. This reduces the throughput of a production line.

A screw connection leads to additional costs for the screw and to increased assembly efforts. Moreover, a visible screw is often not desirable for design reasons.

Semiconductor light fixtures with optical elements are known from the documents DE 10 2007 034 123 A1, US 2008/0130137 A1, DE 10 2014 213 388 A1, US 2011/0180819 A1 and US 2009/0268470 A1.

SUMMARY OF THE INVENTION

Starting from the known prior art, it is an object of the present invention to provide an improved light fixture as well as a corresponding method for production thereof.

This object is achieved by a light fixture and a method for production thereof with the features of the independent claims. Advantageous further embodiments are set out in the subordinate claims.

A lighting device according to the invention has a light module and a lens mechanically connected to the light module. The lens can be connected to a housing in which the light module is arranged. The light module has at least one light source, from which the light generated in operation can leave the housing through a light outlet opening. The light outlet opening is at least partially covered by the lens which, in addition to the protection of the components, is arranged in the interior of the lighting device, and serves, in particular, for shaping of the exiting light profile. The lens can be designed to be completely transparent, but it can also have sections which are only partially transparent or even opaque. Such sections can serve for example as decorative elements. The lens is preferably manufactured from a plastic, particularly preferably from a thermoplastic plastic.

The lens has one or more connecting pin(s) extending from the lens in a rearward direction. In the present disclosure, in the case of the light fixture "in front" means the region of the light outlet opening and the lens and "at the rear" means the region of a base by which the light fixture can be inserted into a corresponding socket. Thus, the connecting pins extend towards the rear starting from the lens.

The base of the light fixture can be any base such as a screw base (Edison base), bayonet base, and pin base (bipin base).

The light module has one or more receiving openings, in particular pass-through receiving openings, which serve to receive the connecting pins. The connecting pins extend in the receiving openings through the light module, so that the ends of the connecting pins are free, i.e. are not located inside the light module.

The free ends of the connecting pins are deformed by thermal forming so that the light module is held on the lens. In particular, the free ends of the connecting pins have a flange which is produced by thermal forming and of which the diameter is greater than the diameter of the receiving openings of the light module.

The thermal forming can take place for example by staking, in which a heated press plunger is pressed from the rear against the free ends of the connecting pins. As a result, the material of the connecting pins melts and is pressed into the required, for example flange-like shape. After the required shape is achieved, the press plunger is removed again. The heated material cools and becomes solid again, while retaining the new shape.

The thermal forming of the free ends of the connecting pins ensures a reliable and permanent connection of the lens and the light module. In particular in thermal forming, no tolerances of the components in the longitudinal direction have to be taken into consideration. If the lens is produced in an injection molding process, also no undercuts in the casting mold are necessary, such as in the case of snap connections. This simplifies the production of the lens.

The connecting pins can have a changing diameter along their distance. In particular, the diameter can change in stages and/or continuously. For example, the connecting pins can have a first diameter in the front region facing the lens and can have a second diameter, which is smaller than the first diameter, in the rear region facing away from the lens (with the exception of the thermally formed section). The first diameter can be greater than the diameter of the receiving openings of the light module, so that the front region of the connecting pins with the greater diameter can serve as a stop for the mounting of the light module. Thus, a predetermined spacing, which can be necessary for the required shaping of the light profile through the lens, can be defined between the lens and the light module.

The cross-sectional shape of the connecting pins can be circular, elliptical or polygonal. If the cross-section of the connecting pins does not have a circular shape, "diameter" should be understood to mean a dimension of the cross-section (thickness of the connecting pin).

The number of connecting pins can be 1, 2, 3, 4 or more. The connecting pins can be arranged symmetrically relative to the lens.

According to the invention, the light module has a circuit board with one or more semiconductor light sources, in particular LEDs. The semiconductor light sources are arranged on the front face of the circuit board, so that the light emitted by the semiconductor light sources can exit from the light fixture through the lens. The light module can, in particular, comprise an individual semiconductor light source arranged centrally on the circuit board.

In one embodiment, the circuit board also has electronic components of an electronic driver which serves for controlling the semiconductor light sources. This embodiment enables a particularly simple mounting of the light fixture, since the lens, light sources and driver are first of all assembled to a unit and can then be inserted jointly into the housing. Then the driver must merely be electrically connected to the electrical connectors of the light fixture in the base and the lens mechanically connected to the housing.

The mechanical connection between the lens and the housing can be made as in the above-mentioned DE 10 2016 114 643, that is to say by a snap connection or by forming, in particular, thermal forming of the edge of the lens.

The semiconductor light sources are preferably arranged on a first face of the circuit board and the electronic components of the driver are arranged on a second face of the circuit board opposite the first face. In this way the available space is optimally exploited, and the light emission of the semiconductor light sources is not hindered by the electronic components of the driver.

Furthermore, according to the invention, the light module has a cooling element. The cooling element can have one or more receiving openings for receiving the connecting pins. In this way the cooling element can also be, in addition to the light module, securely and permanently fastened to the connecting pins of the lens. The thermal forming of the free ends of the connecting pins then ensures that a contact pressure set during the mounting of the light module and the cooling element between these two elements is also maintained after the mounting.

The cooling element is arranged between the lens and the circuit board, i.e. on the front face of the circuit board. In this case, the semiconductor light sources arranged on the front surface of the circuit board are left free by the cooling element, in order not to block the light emission. For this purpose, the cooling element can have openings through which the semiconductor light sources extend or the light of the semiconductor light sources is emitted. The cooling element can also be formed so that it leaves the semiconductor light sources free, without laterally surrounding the semiconductor light sources from all sides (in the plane of the cooling element). For example, several semiconductor light sources can be arranged in an annular manner with a first diameter on the circuit board and the cooling element can have a second diameter which is smaller than the first diameter.

When the cooling element is arranged between the lens and the circuit board, the spacing between the lens and the semiconductor light sources can also be defined by the cooling element.

Furthermore, according to the invention the cooling element has several projections in the direction of the circuit board. The circuit board can then abut against the projections. Therefore a predetermined spacing corresponding to the height of the projections is produced between the cooling element and the circuit board at the points where no projections are located. All projections preferably have the same height. The spacing between the cooling element and the circuit board can be filled with a heat-conducting substance, for example with heat-conducting paste, thermal grease, TIM (thermal interface material) film, etc.

In one embodiment the cooling element is a metal stamped part, preferably made from a sheet of good heat-conducting metal such as aluminum or copper. The projections of the cooling element can be designed as impressions in the metal stamped part. This simplifies the production of the cooling element. The cooling element can also have a ceramic or a heat-conducting plastic. A cooling element made of heat-conducting plastic can be, for example, very simply produced together with the projections in an injection molding process.

In one embodiment the cooling element is substantially dish-shaped, i.e. it has a substantially flat base section (except for, in particular, the projections) and a wall portion projecting forward in the direction of the lens on the edge of the base section. The wall portion can be straight, so that the dish-shaped cooling element has the shape of a cylinder or a conical section which is open on one side. The wall portion can also have (in the direction towards the front) one or more curved or straight sections.

The cooling element can also be manufactured from a heat-conducting plastic, for example in an injection molding process.

In one embodiment the lighting device is a MR16 or a PAR16 lamp, in particular a MR16 or a PAR16 retrofit lamp.

The present invention also relates to a method for production of a lighting device. The characteristics, features and advantages of the lighting device and its components which are described above also apply, unless otherwise mentioned, for the following description of the method according to the invention. Likewise the characteristics, features and advantages which are described below also apply, unless otherwise mentioned, for the preceding description of the light fixture and its components.

According to the invention a lens with one or more connecting pins is provided. Likewise, a light module with one or more receiving openings for receiving the connecting pins is provided.

The light module is fitted onto the lens so that the connecting pins of the lens extend through the receiving openings of the light module. Then the free ends of the connecting pins, which project out of the light module at the rear end of the receiving openings, are thermally formed. This results in a reliable and permanent connection of the lens and the light module.

The light module has a circuit board with one or more semiconductor light sources and with one or more receiving openings to receive the connecting pins and a cooling element with one or more receiving openings to receive the connecting pins. The cooling element has several projections. The fitting of the light module onto the lens first occurs when the cooling element is fitted onto the lens so that the connecting pins of the lens extend through the receiving openings of the cooling element. Then the circuit board is fitted onto the lens so that the connecting pins of the lens extend through the receiving openings of the circuit board and the circuit board abuts against the cooling element. In this case, the cooling element is fitted onto the lens so that the projections extend in the direction of the circuit board.

If the free ends of the connecting pins, which project out of the circuit board at the rear end of the receiving openings, are thermally formed then a secure and permanent connection of the lens, cooling element and circuit board takes place. In particular during the forming, a predetermined pressure can be exerted by the circuit board on the cooling element. This pressure remains even after the forming, i.e. after the formed section of the connecting pins has cooled again and thus has become solid.

In one embodiment of the method, between the fitting of the cooling element onto the lens and the fitting of the circuit board onto the lens, a heat-conducting substance (for example heat-conducting paste, thermal grease, etc.) can be applied to the cooling element. When the circuit board is fitted on and when the circuit board is pressed onto the cooling element during the thermal forming of the free ends of the connecting pins, the heat-conducting substance can be uniformly distributed between the cooling element and the circuit board. As a result, a good thermal contact between the cooling element and the circuit board can be achieved, which also remains due to the secure connection by the thermal forming.

The heat-conducting substance can be applied to the cooling element, over the entire surface or only at several points.

BRIEF DESCRIPTION OF THE DRAWINGS

Preferred further embodiments of the invention are explained in greater detail by the following description of the drawings. In the drawings.

DETAILED DESCRIPTION OF PREFERRED EXEMPLARY EMBODIMENTS

Figure 1:
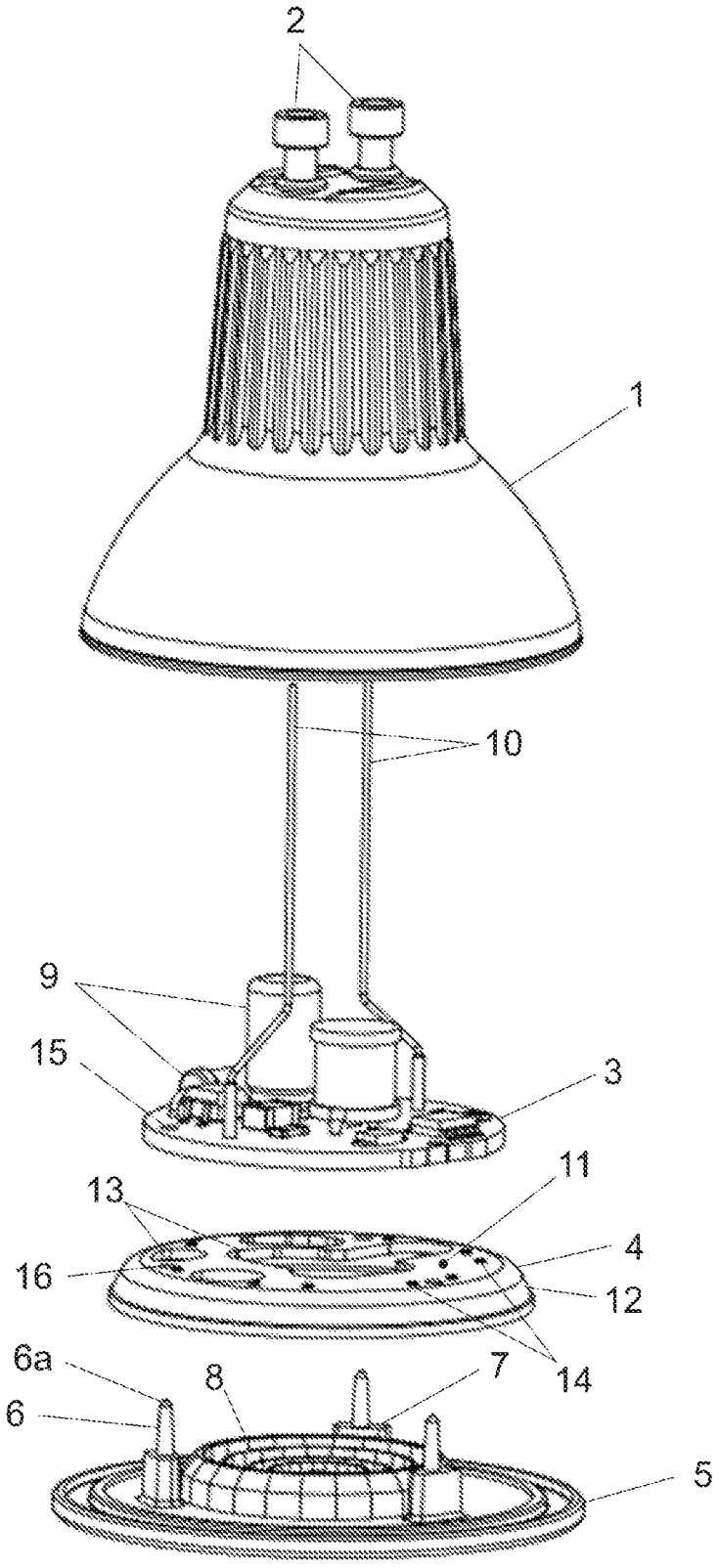
FIG. 1 shows a schematic exploded view of an embodiment of a lighting device according to the invention.

Preferred exemplary embodiments are described below with reference to the drawings. In this case, elements which are the same, similar, or act in the same way are provided with identical reference numerals in the different drawings, and repeated description of some of these elements is omitted in order to avoid redundancies.

FIG. 1 shows a schematic exploded view of an embodiment of a lighting device according to the invention. The lighting device has a housing 1 with a GU10 base with two electrical connection pins 2. A circuit board 3 and a cooling element 4 are arranged in the housing 1. The front end of the housing 1 (at the bottom in the drawing) is closed by a lens 5 made of a thermoplastic, transparent plastic. The lens 5 can for example be adhered to the housing 1 or are also fastened to the housing 1 in other ways.

The lens 5 has three connecting pins 6 which have a polygonal cross-section in a front section (at the bottom in the drawing) and have a round cross-section which tapers towards the rear in a rear section. Between the polygonal section and the round section, a shoulder 7 is provided on which the cooling element 4 can be supported. Each connecting pin 6 has a free end 6*a*.

An annular lens structure 8 which serves for shaping of the exiting beam profile is provided in the center of the lens 5.

Components of an electronic driver 9 are arranged on the rear surface of the circuit board 3 (at the top in the drawing). This serves to supply electrical power with the necessary parameters (current, voltage) to a LED (not shown) which is arranged approximately centrally on the front face of the circuit board 3. Two connecting wires 10 extend rearwards from the circuit board 3 to the connection pins 2 to which they are electrically conductively connected (for example by crimping).

The cooling element 4 has a substantially planar base section 11, the edge of which is adjoined by a wall section 12 directed obliquely forwards. In the assembled state, when the cooling element 4 rests on the shoulders 7 of the connecting pins 6, the front end of the wall section 12 can have a spacing from the inner face of the lens 5.

The cooling element 4 has cutouts 13 which serve to receive the light-emitting diode and the solder points of the wired components 9 on the front face of the circuit board 3.

The cooling element also has projections 14 on which the front face of the circuit board 3 abuts in the assembled state. The intermediate space produced as a result between the circuit board 3 and the cooling element 4 is filled with a heat-conducting paste which during the assembly is applied at certain points to the cooling element. When the circuit board 3 is pressed onto the cooling element 4 the heat-conducting paste is distributed uniformly in the intermediate space defined by the projections 14.

Both the circuit board 3 and the cooling element 4 have receiving openings 15, 16 through which the connecting pins 6 of the lens 5 extend in the assembled state.

Figure 2:
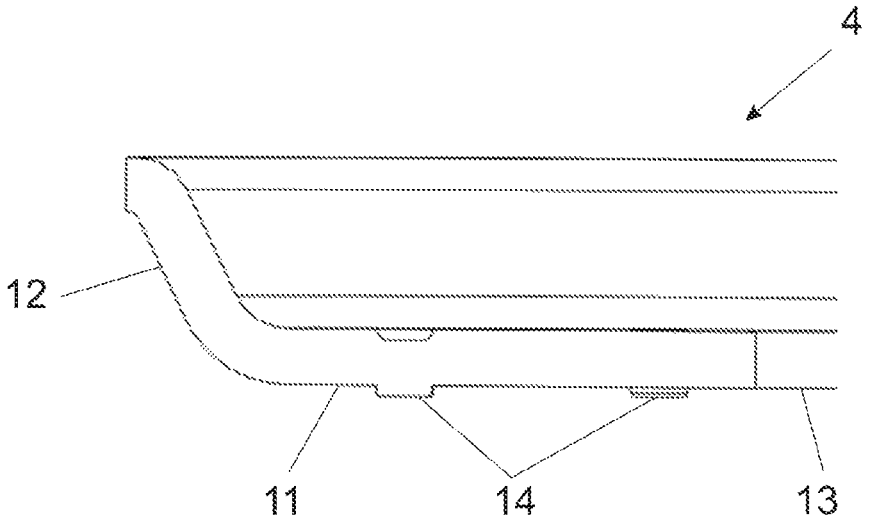
FIG. 2 shows a schematic cross-section through an embodiment of a cooling element of a lighting device according to the invention.

In FIG. 2, a cross-section through an embodiment of the cooling element 4 is shown schematically as a detail. The cooling element 4 is produced from a sheet metal in a stamping process, wherein in one step the cooling element 4 and the cutouts 13 therein is stamped out of the sheet metal and is bent into the required shape. Simultaneously, the projections 14 are impressed into the substantially planar base section 11.

Figure 3A:
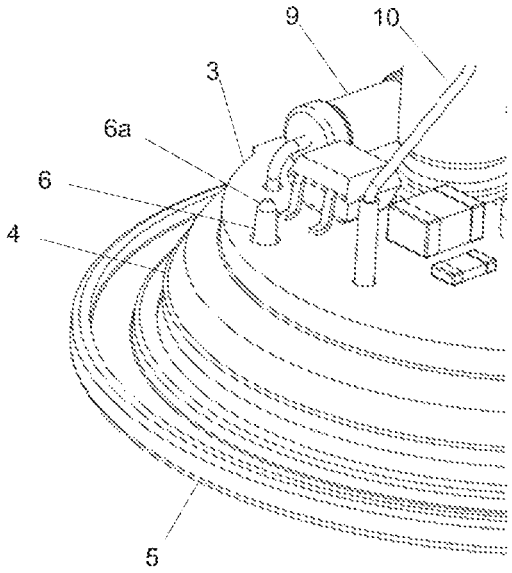
FIG. 3*a* shows a schematic representation of an embodiment of a lighting device according to the invention during the mounting before the thermal forming.
Figure 3B:
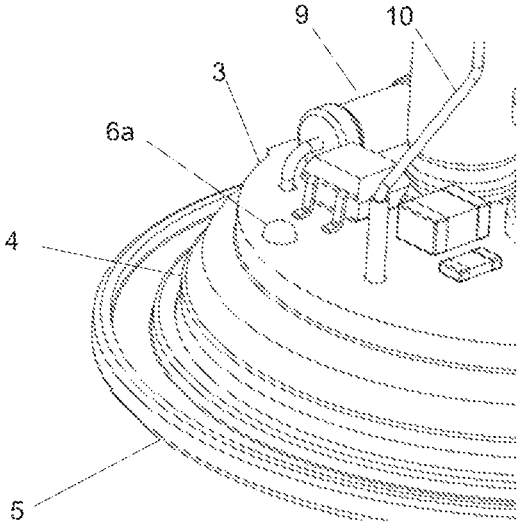
FIG. 3*b* shows a schematic representation of an embodiment according to FIG. 3*a* during the mounting after the thermal forming.

FIGS. 3*a* and 3*b* show an embodiment of a light fixture according to the invention at two points in time during the mounting. FIG. 3*a* shows the state before the thermal forming of the free ends 6*a* of the connecting pins 6, and FIG. 3*b* shows the state before this thermal forming.

Both drawings show how the cooling element 4 is fitted onto the lens 5 and the circuit board 3 is fitted onto the cooling element 4. In this case the cooling element 4 and the circuit board 3 are oriented so that the connecting pins 6 extend through the receiving openings 15, 16, so that the free ends 6*a* of the connecting pins 6 project out of the circuit board 3 at the rear.

In FIG. 3*a* it can be seen that the diameter of the free ends 6*a* of the connecting pins 6 is smaller than the diameter of the receiving openings 15 in the circuit board (and naturally also less than the diameter of the receiving openings 16 in the cooling element, which cannot be seen here).

FIG. 3*b* shows that the free ends 6*a* of the connecting pins 6 have been given a substantially hemispherical shape by thermal forming. In particular, the section of the formed free ends 6*a* abutting against the circuit board 3 has a diameter which is greater than the diameter of the receiving openings 15 in the circuit board. As a result, the circuit board 3, and with it the cooling element 4, is mechanically connected permanently and securely to the lens 5.

Although the invention has been illustrated and described in greater detail by the depicted exemplary embodiments, the invention is not restricted thereto and other variations can be deduced therefrom by the person skilled in the art without departing from the scope of protection of the invention.

In general "a" or "an" may be understood as a single number or a plurality, in particular in the context of "at least one" or "one or more" etc., provided that this is not explicitly precluded, for example by the expression "precisely one" etc.

Also, when a number is given this may encompass precisely the stated number and also a conventional tolerance range, provided that this is not explicitly ruled out.

If applicable, all individual features which are set out in the exemplary embodiments can be combined with one another and/or exchanged for one another, without departing from the scope of the invention.

LIST OF REFERENCES

1 housing
2 connection pins
3 circuit board
4 cooling element
5 lens
6 connecting pins
6*a* free ends of the connecting pins
7 shoulder
8 annular lens structure
9 components of the electronic driver
10 connecting wires
11 base section
12 wall section
13 cutouts
14 projections
15 receiving openings in the circuit board
16 receiving openings in the cooling element

The invention claimed is:

1. A lighting device comprising:
a light module comprising:
a circuit board with one or more semiconductor light sources; and
a cooling element having one or more receiving openings; and
a lens having one or more connecting pins received in the one or more receiving openings, wherein a free end of the one or more connecting pins is deformed by thermal forming so that the lens is mechanically connected thereby to the light module;
wherein the cooling element is arranged between the lens and the circuit board; and
wherein the cooling element has a plurality of projections that extends in a direction of the circuit board.

2. The lighting device according to claim 1, wherein the circuit board has electronic components of an electronic driver.

3. The lighting device according to claim 2, wherein the one or more semiconductor light sources are arranged on a first face of the circuit board and the electronic components are arranged on a second face of the circuit board opposite the first face.

4. The lighting device according to claim 1, wherein the cooling element is a metal stamped part and wherein the projections are formed as impressions.

5. The lighting device according to claim 1, further comprising at least one of a heat-conducting paste, a thermal grease, and a thermal interface material (TIM) film disposed within an intermediate space defined by the projections.

6. The lighting device according to claim 1, wherein the projections are provided as impressions in the cooling element.

7. The lighting device according to claim 1, wherein the projections extend in the direction of the circuit board such that, in having the circuit board abut against the projections, a predetermined spacing is provided between the cooling element and the circuit board.

8. The lighting device according to claim 7, wherein the projections are of substantially similar height extending in the direction of the circuit board.

9. The lighting device according to claim 1, wherein the one or more connecting pins extend in the one or more receiving openings through the light module so that the free end of the one or more connecting pins is not located inside the light module.

10. The lighting device according to claim 1, wherein in being deformed by thermal forming, the free end of the one or more connecting pins has a flange portion of greater diameter than a corresponding one or more receiving opening of the light module.

11. The lighting device according to claim 1, wherein the one or more connecting pins change in diameter along a longitudinal length thereof.

12. The lighting device according to claim 11, wherein the change in diameter is substantially continuous along the longitudinal length.

13. The lighting device according to claim 11, wherein the change in diameter is provided in stages along the longitudinal length.

14. The lighting device according to claim 11, wherein the change in diameter provides a stop region along the longitudinal length such that, in interfacing the lens and the light module, a predetermined spacing is provided between the lens and the light module.

15. The lighting device according to claim 14, wherein the stop region is configured as a shoulder where a first portion of the one or more connecting pins transitions to a second portion of the one or more connecting pins, wherein the first portion and the second portion are of differing cross-sectional geometries.

16. The lighting device according to claim 14, wherein the predetermined spacing corresponds with a distance utilized in providing a target light profile through the lens.

17. The lighting device according to claim 1, wherein in having the free end of the one or more connecting pins be deformed by thermal forming, a contact pressure between the light module and the cooling element which is set during the interfacing of the light module and the cooling element is maintained after such interfacing.

18. A method for producing a lighting device, the method comprising:
forming a lens with one or more connecting pins;
forming a light module comprising:
a circuit board with one or more semiconductor light sources; and
a cooling element with one or more receiving openings to receive the one or more connecting pins, wherein the cooling element has a plurality of projections;
fitting the cooling element onto the lens so that the one or more connecting pins of the lens extend through the one or more receiving openings of the cooling element;
fitting the circuit board onto the lens so that the one or more connecting pins of the lens extend through the one or more receiving openings of the circuit board and the circuit board abuts against the cooling element, wherein the cooling element is fitted onto the lens so that the projections extend in a direction of the circuit board; and thermal forming the free ends of the one or more connecting pins so that the lens is mechanically connected thereby to the light module.

19. The method according to claim 18, further comprising:

applying a heat-conducting substance to the cooling element before fitting the circuit board onto the lens.

20. The method according to claim 19, wherein the heat-conducting substance is distributed substantially uniformly in an intermediate space defined by the projections.

* * * * *